US008968832B2

(12) United States Patent
Ciampini et al.

(10) Patent No.: US 8,968,832 B2
(45) Date of Patent: Mar. 3, 2015

(54) INK-JET PRINT HEAD HAVING IMPROVED ADHESION WITH TIME, ITS PROCESS OF MANUFACTURING AND ITS USE IN COMBINATION WITH A WATER-BASED INK CONTAINING ACIDIC SPECIES

(75) Inventors: Davide Ciampini, Arnad (IT); Norma Giordano, Arnad (IT); Luigina Gino, Arnad (IT); Fulvio Cominetti, Arnad (IT)

(73) Assignee: SICPA Holding SA, Prilly (CH)

( * ) Notice: Subject to any disclaimer, the term of this patent is extended or adjusted under 35 U.S.C. 154(b) by 1019 days.

(21) Appl. No.: 12/988,490

(22) PCT Filed: Apr. 18, 2008

(86) PCT No.: PCT/IT2008/000267

§ 371 (c)(1),
(2), (4) Date: Oct. 18, 2010

(87) PCT Pub. No.: WO2009/128105

PCT Pub. Date: Oct. 22, 2009

(65) Prior Publication Data

US 2011/0063361 A1 Mar. 17, 2011

(51) Int. Cl.
*B05D 3/10* (2006.01)
*B41J 2/16* (2006.01)

(52) U.S. Cl.
CPC ..... *B41J 2/1639* (2013.01); *B41J 2/1603* (2013.01); *B41J 2/1626* (2013.01); *B41J 2/1631* (2013.01); *B41J 2/1645* (2013.01)
USPC ..... 427/340; 427/207.1; 427/337; 427/341; 427/407.1

(58) Field of Classification Search
None
See application file for complete search history.

(56) References Cited

U.S. PATENT DOCUMENTS

| | | | | |
|---|---|---|---|---|
| 4,685,968 | A | 8/1987 | Palmer | |
| 5,150,132 | A | 9/1992 | Shimomura et al. | |
| 6,455,112 | B1 | 9/2002 | Ohkuma et al. | |
| 6,638,439 | B2 | 10/2003 | Shimomura | |
| 6,793,326 | B2 | 9/2004 | Imamura et al. | |
| 2002/0005885 | A1 * | 1/2002 | Katsuragi et al. | 347/100 |
| 2004/0209976 | A1 * | 10/2004 | Nakhmanovich et al. | 523/160 |
| 2006/0134555 | A1 | 6/2006 | Park et al. | |
| 2008/0088673 | A1 | 4/2008 | Sexton | |

FOREIGN PATENT DOCUMENTS

EP 1 254 921 A1 11/2002

OTHER PUBLICATIONS

International Search Report of PCT/IT2008/000267 Dated Jan. 16, 2009.

* cited by examiner

*Primary Examiner* — Erma Cameron
(74) *Attorney, Agent, or Firm* — Greenblum & Bernstein, P.L.C.

(57) ABSTRACT

The present invention relates to an ink-jet print head for an ink-jet printer comprising at least a substrate and a photopolymer barrier applied onto said substrate, said photopolymer barrier comprising an adhesive first layer and a second layer made of a photopolymerizable material and applied above said first layer, characterized in that said adhesive first layer is made of a cationically polymerizable material partially polymerized that, when contacted ny a water-based ink containing acidic species, is able to further polymerize, thus improving the photopolymer barrier adhesion on said surface of said substrate with time, the present invention also relates to a process of manufacturing said ink-jet print head and to its use in combination with a water-based ink containing acidic species.

11 Claims, 3 Drawing Sheets

INK-JET PRINT HEAD HAVING IMPROVED ADHESION WITH TIME, ITS PROCESS OF MANUFACTURING AND ITS USE IN COMBINATION WITH A WATER-BASED INK CONTAINING ACIDIC SPECIES

CROSS-REFERENCE TO RELATED APPLICATIONS

The present application is a U.S. National Stage of International Application No. PCT/IT2008/000267 filed Apr. 18, 2008, designating the United States.

BACKGROUND OF THE INVENTION

1. Field of the Invention

The present invention relates to an ink-jet print head having improved adhesion with time, to its process of manufacturing and to its use in combination with a water-based ink containing acidic species.

2. Description of Related Art

The ink-jet print head of an ink-jet printer generally comprises a substrate, a barrier layer and a nozzle plate. The substrate is generally made of silicon. Various layers are deposited on a face of the silicon substrate to make up the ejection resistors and the active electronic components. The barrier layer is generally made of a photopolymer. Using photolithographic techniques, the ejection chambers and the micro-hydraulic conducts for the ink delivery are realised in the photopolymer barrier layer. The nozzle plate is generally made of a metal, such as gold plated nickel. The nozzle plate provided with ejection nozzles made in correspondence with the ejection resistors and the ejection chambers is attached to the barrier layer. This kind of print heads are usually called "hybrid print heads".

In recent years, the nozzle plate has been made integrally with the barrier layer. The layer forming the barrier layer and the nozzle plate is known in the art as structural layer. In such a case, the manufacturing process includes a step of forming a pattern of the ejection chambers and the micro-hydraulic conducts with a soluble resin, a step of coating a photopolymer covering the soluble resin pattern, a step of forming orifices in the photopolymer in correspondence of the ejection chambers over the ejection resistors, a step of curing the photopolymer, and a step of dissolving the soluble resin. This kind of print heads are usually called "monolithic print heads".

There are some problems that arise with respect to the photopolymer employed to make either the barrier layer or the structural layer.

A first problem is that the ink chemically attacks the photopolymer material and causes either leakage between the channels and/or leakage to the outside of the print heads and also causes swelling of the barriers. Swelling results in a change in channel geometry and a degradation from optimised performance.

The main problem, however, is adhesion of the photopolymer layer to the substrate and/or to the nozzle plate. Conventional ink-jet print heads comprise nozzle plates having a surface of gold or other noble metals and also, the ejection resistors and the active electronic components realised on the substrate often comprise metal surfaces of gold or other materials showing low adhesion characteristics; therefore, the problem of adhesion is linked with the chemical nature of the surface.

Further, the adhesion of the photopolymer layer to the substrate and/or to the nozzle plate is also jeopardised by the mechanical strength of the photopolymer material, in particular when the manufacturing process of the print head requires thermal treatments. The thermal treatments promote the formation of mechanical stress that cannot be compensated by a material having high mechanical strength.

Last but non least factor causing the problem of adhesion is the chemical action of the ink with respect to the photopolymer with time. The chemical resistance of a photopolymer to inks is of main importance because the material permeability to a liquid sooner or later will originate detachments at the photopolymer/substrate interface; said detachments, which can be followed by the liquid infiltration, generate electrical defects and, therefore, the malfunctioning of print heads.

U.S. Pat. No. 5,150,132 discloses an ink resistant material useful to make any component, particularly a top plate, of a print head having a surface contacting the ink. The material is disclosed to have high glass transition point and excellent heat resistant properties. The component of the print head is disclosed to be realised by moulding, preferably by casting moulding, compression moulding or compression moulding.

However, the Applicant has noticed that when the material according to the above patent is employed to make a photopolymer layer, the high glass transition point, particularly higher than 180° C., gives to the material an excessive mechanical strength favouring the detachment of the layer from metal surfaces of gold or other metals showing low adhesion characteristics. Further, the use of moulding techniques to realise the barrier or structural layer of a print head is difficult and expensive in view of the reduced dimensions, in the order of some micrometers, connected with the manufacturing thereof.

U.S. Pat. Nos. 6,455,112 and 6,638,439 disclose the use of polyfunctional epoxy resins having oxycyclohexane skeleton to form structural layers of an ink-jet print head.

However, the Applicant has noticed that the high mechanical strength and Tg of the above mentioned resin compositions promote the detachment of the photopolymer layer from metal surfaces of gold or other metals showing low adhesion characteristics.

U.S. Pat. No. 6,793,326 discloses that structural layers made of cationically polymerised product of alicyclic epoxy resins showed a peeling in case of high internal stress because of a high mechanical strength. The proposed solution suggests to make the structural layer by curing a radiation curable resin composition comprising an epoxy resin having at least two epoxy groups and obtained from the polymerisation of an acrylic monomers bearing epoxy groups.

However, the Applicant has noticed that the epoxy resin obtained from the polymerisation of an acrylic monomers bearing epoxy groups did not show the optimal adhesion characteristics required to form a photopolymer layer of an ink-jet print head.

U.S. Pat. No. 4,685,968 discloses an aqueous-based ink for ink-jet printers comprising a vehicle of about 5 to 95% by weight water and the balance at least one glycol ether, a dye, present in an amount up to about 10% by weight of the vehicle composition, and a cationic compound selected from the group consisting of alkanol ammonium compounds and cationic amide compounds, present in an amount such that there is at least one molecule of cationic compound for at least one of the negatively charged functional groups on the dye. Said ink compositions evidence minimal crusting and reduced evaporation loss of water thanks to the fact that the solubility of anionic dyes is increased in acidic media over that otherwise obtainable, due to the presence of the alkanol ammonium compound or amide cation; chloride is disclosed to be an appropriate anion to employ with the alkanol ammonium species, and hydrochloric acid is suitably used to reduce the pH.

However, the Applicant has noticed that the use of chloride anions cause corrosion effects on the print head.

European Patent No. 1 254 921 B1 discloses an ink-jet ink composition for ink-jet printers comprising at least one colorant and a vehicle including at least one organo-phosphonic acid, said composition being able to control bleed and yet to exhibit favourable interactions with the components of the pen structure and in particular with the adhesives commonly used in ink-jet printer pens, thus reducing structural adhesive swell.

However, the Applicant has noticed that the interactions between the ink-jet inks according to the above patent and print head structure still affect in particular the long term reliability of print head performance, being adhesion with time not sufficient.

The foregoing status of the art thus indicates that there is a need for a continuous research and improvement for ink-jet print heads that, when contacted by a water-based ink, are able to improve the adhesion with time, and can be easily employed in manufacturing processes.

SUMMARY OF THE INVENTION

The present invention relates to an ink-jet print head for an ink-jet printer comprising at least a substrate and a photopolymer barrier applied onto said substrate, said photopolymer barrier comprising an adhesive first layer and a second layer made of a photopolymerisable material and applied above said first layer, characterised in that said adhesive first layer is made of a cationically polymerisable material partially polymerised that, when contacted by a water-based ink containing acidic species, is able to further polymerise, thus improving the photopolymer barrier adhesion on said surface of said substrate with time.

The present invention also relates to a process for manufacturing an ink-jet print head for an ink-jet printer comprising a photopolymer barrier defining ink passage ways and ejection chambers formed on a substrate, said process comprising the steps of:

- providing a substrate,
- applying, on a surface of said substrate, an adhesive first layer of a photopolymer barrier, said first layer being made of a cationically polymerisable material partially polymerised,
- applying a second layer above said first layer, said second layer being made of photopolymerisable material,
- defining ink passage ways and ejection chambers, and
- contacting said ink-jet print head with a water-based ink containing acidic species so as to make said adhesive first layer partially polymerised of said photopolymer barrier to further polymerise, thus improving the photopolymer barrier adhesion on said surface of said substrate with time.

Preferably the substrate comprises a plurality of ink ejection energy generating elements on a surface thereof.

The present invention also relates to the use of an ink-jet print head for an ink-jet printer in combination with a water-based ink containing acidic species, said ink-jet print head comprising at least a substrate and a photopolymer barrier applied onto said substrate, said photopolymer barrier comprising an adhesive first layer and a second layer applied above said first layer, said first adhesive layer being made of a cationically polymerisable material partially polymerised and said second layer being made of a photopolymerisable material, said adhesive first layer being able to further polymerise when contacted by said water-based ink containing acidic species, thus improving the photopolymer barrier adhesion on said surface of said substrate with time.

The present invention also relates to an ink-jet print head for an ink-jet printer combined with a water-based ink containing acidic species, said ink-jet print head comprising at least a substrate and a photopolymer barrier applied onto said substrate, said photopolymer barrier comprising an adhesive first layer and a second layer applied above said first layer, said first adhesive layer being made of a cationically polymerisable material partially polymerised and said second layer being made of a photopolymerisable material, said adhesive first layer being able to further polymerise when contacted by said water-based ink containing acidic species, thus improving the photopolymer barrier adhesion on said surface of said substrate with time.

The Applicant has found that a greater cross-linking of the photopolymer barrier applied onto the substrate of an ink-jet print head turns into an increase of the chemical resistance to the external agents and improves the photopolymer barrier adhesion on said substrate with time.

The Applicant has also found that said greater cross-linking of the photopolymer barrier is obtained by contacting the ink-jet print head with a water-based ink containing acidic species.

The Applicant has also found that said water-based ink containing acidic species is obtained by adding to water an acid or a substance able to release an acid. Preferably, said acid or said substance able to release an acid is selected from the group consisting of non-corrosive inorganic acids, organic acids, hydrolysable salts and hydrolysable esters. Preferably, said acid or said substance able to release an acid is selected from the group consisting of organic acids, hydrolysable salts and hydrolysable esters. More preferably, said acid or said substance able to release an acid is selected from the group consisting of hydrolysable salts and esters. Even more preferably, said acid or said substance able to release an acid is selected among hydrolysable esters. Said hydrolysable esters can be hydrolysable acrylic esters, preferably PEG diacrylates, more preferably PEG diacrylates with molecular weight comprised between 200 amu and 1,000 amu.

DETAILED DESCRIPTION OF THE INVENTION

Figure 1:
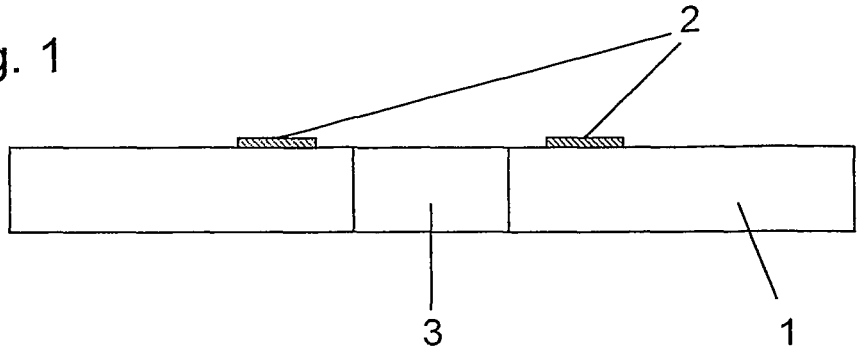
FIG. 1 shows a schematic section view of a substrate for a monolithic ink-jet print head.

The ink-jet print head of the present invention comprises at least a substrate and a photopolymer barrier applied onto said substrate.

Said photopolymer barrier comprises an adhesive first layer; said adhesive first layer is made of a cationically polymerisable material partially polymerised.

Preferably, said cationically polymerisable material partially polymerised forming said adhesive first layer is selected from the group consisting of epoxy or olefinic resins (as used herein, the term "olefinic resins" includes all the polymeric materials obtained by the polymerization of an unsaturated group), more preferably from the group consisting of aromatic epoxy resins; useful examples of aromatic epoxy based photopolymers include SU-8 by MicroChem Corporation, TMMR 2000 by Tokyo Ohka Kogyo Company.

Said adhesive first layer has a thickness comprised between 1 μm and 10 μm; preferably, said adhesive first layer has a thickness comprised between 1 μm and 3 μm.

Said photopolymer barrier also comprises a second layer applied above, typically onto, said first layer; said second layer is made of a photopolymerisable material.

Preferably, said photopolymerisable material forming said second layer is selected from the group consisting of epoxy-olefinic polymers.

Said second layer has a thickness comprised between 5 μm and 50 μm; preferably, said second layer has a thickness comprised between 10 μm and 20 μm.

Said cationically polymerisable material partially polymerised forming said adhesive first layer is able to further polymerise, or preferably to completely polymerise, when contacted by a water-based ink containing acidic species.

Said water-based ink containing acidic species is obtained by adding to water an acid or a substance able to release an acid.

Said acid or said substance able to release an acid can be selected from the group consisting of non-corrosive inorganic acids, organic acids, hydrolysable salts and hydrolysable esters; preferably it is selected from the group consisting of organic acids, hydrolysable salts and hydrolysable esters; more preferably it is selected from the group consisting of hydrolysable salts and esters and even more preferably it is selected among hydrolysable esters, wherein said hydrolysable esters are preferably hydrolysable acrylic esters, wherein said hydrolysable acrylic esters are preferably PEG diacrylates, and wherein said hydrolysable acrylic esters are preferably PEG diacrylates with molecular weight comprised between 200 amu and 1,000 amu.

Said water-based ink containing acidic species either has a pH value comprised between 3 and 5 or reaches a pH value comprised between 3 and 5 during time.

Said substrate is typically made of a material selected from the group consisting of glass, metal, plastic, ceramic and silicon.

Said substrate is typically covered, preferably in part, by a material selected among gold, tantalum and silicon carbide.

The ink-jet print head of the present invention can comprise further elements as known in the art. For example, the ink-jet print head further comprises an opening for feeding ink through said substrate.

With reference to FIG. 1, the substrate 1 of the ink-jet print head may be of any shape or any material as long as it can function as a part of the liquid flow path constituting member and as a support for the material layers that form the ink flow path and ink ejection outlets to be described later; as already mentioned hereinabove, the substrate can be made, e.g., from glass, metal, plastic, ceramic or silicon.

On the substrate 1 are disposed a desired number of ink ejection energy generating elements 2, such as electrothermal converting elements or piezoelectric elements (in FIG. 1, two such elements 2 are exemplified). By the ink ejection energy generating elements 2, ejection energy for ejecting droplets of a recording liquid is imparted to the ink, and recording done. Incidentally, when an electrothermal converting element is used as the ink ejection energy generating element 2, this element heats a nearby recording liquid, to generate vapour bubbles in the recording liquid, thereby generating an ejection energy. When a piezoelectric element is used, on the other hand, an ejection energy is generated by its mechanical vibrations.

To these elements 2 control signal input electrodes (not shown) are connected for causing these elements to act. In an attempt to improve the durability of these ejection energy generating elements, it is customary practice to provide various functional layers such as protective layers.

According to a preferred aspect, the substrate will typically include a silicon substrate upon which a thin layer of silicon dioxide is deposited for passivating and insulating the surface of the silicon substrate. A plurality of heater resistors are formed on the upper surface of the silicon dioxide layer and will typically be either tantalum aluminium or tantalum pentoxide and fabricated using known photolithographic masking and etching techniques. Aluminium trace conductors make electrical contact to the heater resistors for providing electrical pulses thereto during an ink-jet printing operation, and these conductors are formed from a layer of aluminium previously evaporated on the upper surface of the silicon layer using conventional metal evaporation processes.

After the formation of the aluminium conductors is completed, a surface layer, typically of silicon carbide or silicon nitride, is deposited over the upper surfaces of the conductors and the heater resistors to protect these members form cavitation wear and the ink corrosion that would otherwise be caused by the highly corrosive ink located in the reservoirs directly above these heater resistors. The silicon carbide layer, as well as the previously identified $SiO_2$ surface layer, resistors and aluminium conductors are all formed using semiconductor processes well known to those skilled in thermal ink-jet and semiconductor processing arts and for that reason are not described in detail herein.

FIG. 1 exemplifies a form in which an opening 3 for feeding ink is provided in the substrate beforehand, and ink is fed from behind the substrate. In forming the opening, any means can be used so long as it is capable of forming a hole in the substrate. For instance, mechanical means such as a drill, or a light energy such as laser may be employed; sand blasting may be employed too. Alternatively, it is permissible to form a resist pattern or the like in the substrate, and chemically etch it. The ink feed inlet may be formed in the resin pattern rather than in the substrate, and provided on the same plane as the ink ejection outlets with respect to the substrate.

The adhesive first layer of the photopolymer barrier according to the present invention is applied on a surface of the substrate. A method for applying said layer to the substrate involves centering the substrate on an appropriate sized chuck of either a resist spinner or conventional wafer resist deposition track; obviously, other methods for applying said layer to the substrate can be used such as for instance the spray coating, which are well known to the person skilled in the art. Depending on the method used for applying said layer to the substrate, said adhesive first layer can be either liquid, with or without the use of a solvent or diluent, or solid, preferably under the form of a dry film, at room temperature.

Preferably, said adhesive first layer of photopolymer barrier is applied on said surface of said substrate by spin coating or spray coating said cationically polymerisable material on said substrate.

The resulting coated substrate is then subjected, if necessary, to a thermal treatment by placing it on either a temperature controlled hotplate or in a temperature controlled oven. This optional thermal treatment removes, if present, a portion of the solvent from the liquid resulting in a partially dried film on the substrate. Additionally, the optional thermal treatment promotes the polymerisation of the non photoreactive thermally polymerisable compounds, if present in the composition. The substrate is then removed from the heat source and allowed to cool to room temperature. Obviously, depending on the physico-chemical properties of the deposited polymer, other thermal treatments can be used, which are well known to the person skilled in the art.

Similarly, the second layer of the photopolymer bather according to the present invention is applied above, e.g., on said first layer; as the procedure is substantially the same as above described for the adhesive first layer, it will be not repeated.

Preferably, said second layer of photopolymer barrier is applied on said first layer by laminating, spin coating or spray coating said photopolymerisable material on said first layer.

The ink passage ways defined by the polymeric material layers formed onto the substrate are realised by any method known in the art.

For example, the ink passage ways can be defined by forming a structural layer wherein both the barrier layer and the nozzle plate are integrally realised within said layers. Alternatively, the ink passage ways can be defined by first forming the photopolymer barrier and then applying to said photopolymer barrier a separately formed nozzle plate.

Figure 2:
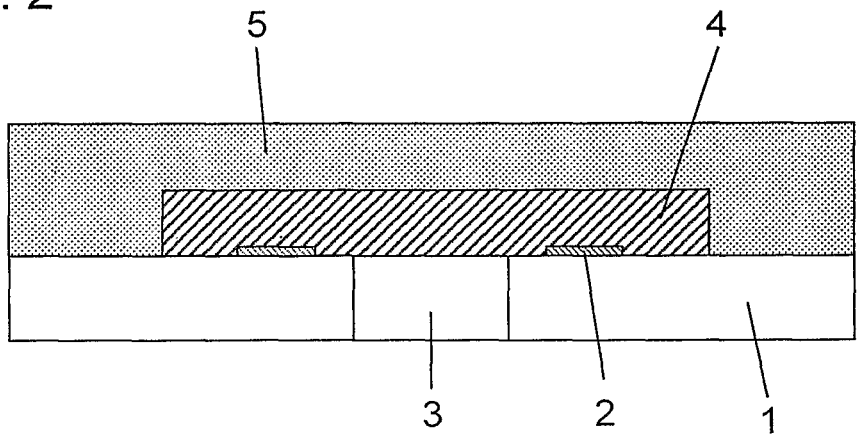
FIG. 2 shows a schematic section view of a semifinished monolithic ink-jet print head with a structural layer.
Figure 3:
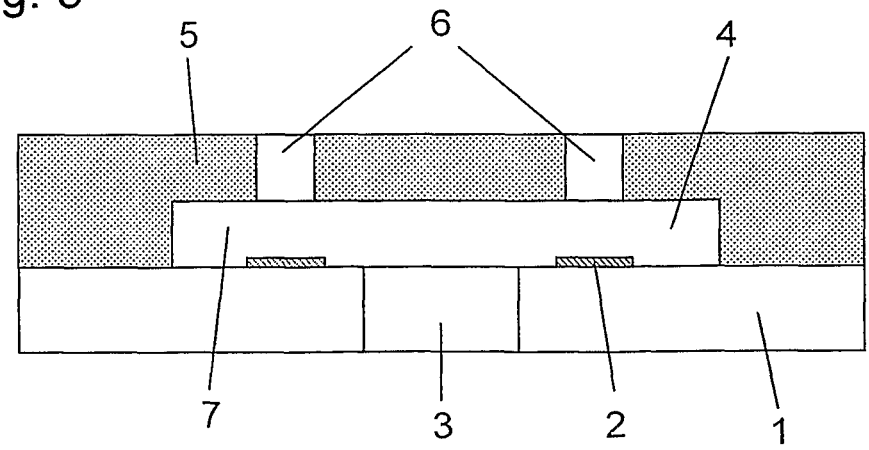
FIG. 3 shows a schematic section view of a complete finished monolithic ink-jet print head with a structural layer.

With reference to FIGS. 2 and 3, when a structural layer is formed, the ink passage ways are formed by realizing a pattern 4 from a dissoluble resin before applying the photopolymer barrier layer of the present invention. The most common means for forming the pattern 4 would be one using a photosensitive material, but means such as screen printing can be employed. When the photosensitive material is used, a positive resist can be used. The photosensitive resist is applied to the substrate by any method known in the art in order to form a film having the desired thickness. In order to define the pattern 4 in the resulting film, the material must be masked, exposed to a collimated ultraviolet light source, baked after exposure and developed to define the final pattern 4 by removing unneeded material. This procedure is very similar to a standard semiconductor lithographic process. The mask is a clear, flat substrate usually glass or quartz with opaque areas defining the pattern to be maintained from the coated film. The developer comes in contact with the coated substrate through either immersion and agitation in a tank-like setup or by spray. Either spray or immersion of the substrate will adequately remove the excess material as defined by the photo masking and exposure. On the pattern 4 of dissoluble resin material a photopolymer barrier layer 5 is then formed, as illustrated in FIG. 2, by subsequently applying the adhesive first layer and the second layer of the present invention. After that, as depicted in FIG. 3, a pattern of ejection nozzles 6 are made in the photopolymer barrier layer 5 in correspondence with the ejection resistors 2 and the ejection chambers 7 by using photolithographic techniques similar to those described above, and the dissoluble resin 4 forming the pattern of the ink passage ways is dissolved with a solvent. The dissolution is easily performed by dipping the substrate in the solvent or spraying the solvent on the substrate. Joint use of ultrasonic waves can shorten the duration of dissolution.

Figure 4:
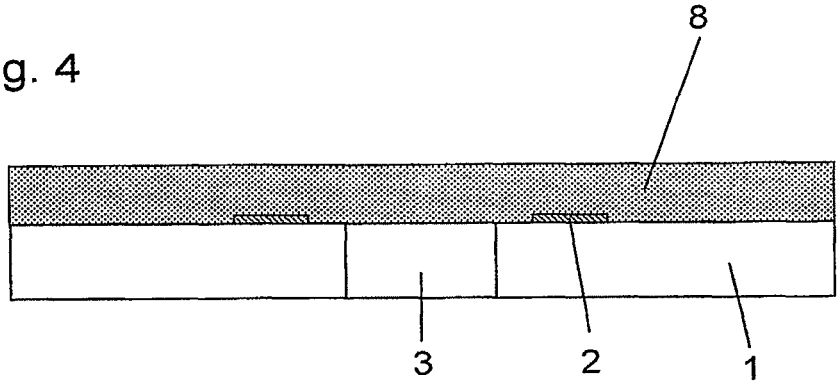
FIGS. 4 and 5 show a schematic section view of a semifinished hybrid ink-jet print head with a photopolymer barrier at two different steps of its manufacturing process.
Figure 5:
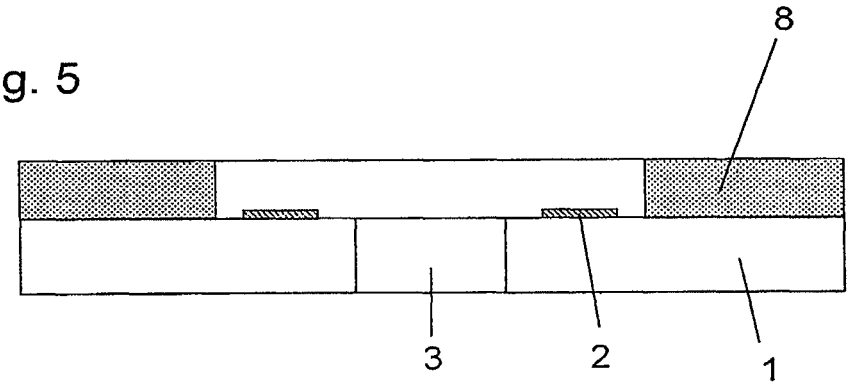
Figure 6:
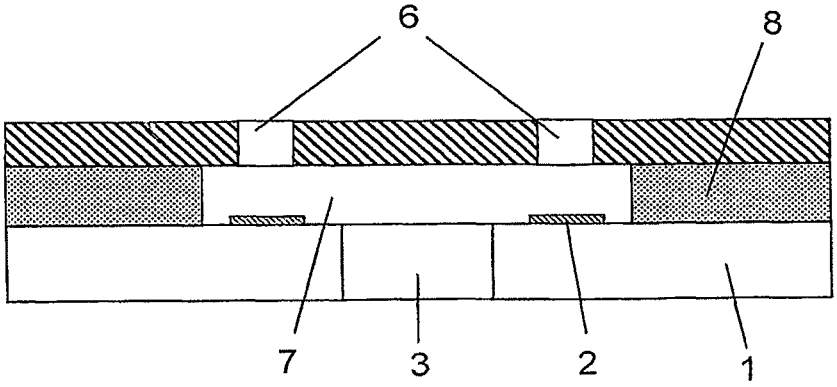
FIG. 6 shows a schematic section view of a complete finished hybrid ink-jet print head with a photopolymer barrier.

With reference to FIGS. 4 and 6, when a photopolymer barrier is formed, the ink passage ways are formed by realizing a pattern within the photopolymer barrier layer 8 formed with the adhesive first layer and the second layer of the present invention after their subsequent application on the substrate 1. Similarly to what described above for defining the pattern 4 within the dissoluble resin, the photopolymer barrier of the present invention must be masked, exposed to a collimated ultraviolet light source, baked after exposure and developed to define the final pattern by removing unneeded material. The mask is a clear, flat substrate usually glass or quartz with opaque areas defining the pattern to be removed from the coated film.

Preferably, the step of defining ink passage ways and ejection chambers is made by:

- realizing a pattern made of a removable material defining ink passage ways and ejection chambers on said surface of said substrate, before said step of applying said first and second layers of photopolymer barrier, and
- removing said pattern made of a removable material, after said step of applying said first and second layers of photopolymer barrier.

The invention will be now better described by means of the following examples, which are intended to be for illustrative purpose only and in no way limiting the scope of the invention.

EXAMPLES

The following examples report the results of adhesion tests.

Six different formulations of water-based ink containing the same colorant have been prepared, said formulations are reported in the following table:

| | Formulation "A" (%) | Formulation "B" (%) | Formulation "C" (%) | Formulation "D" (%) | Formulation "E" (%) | Formulation "F" (%) |
|---|---|---|---|---|---|---|
| Deionised $H_2O$ | 70.1 | 70.1 | 70.1 | 70.1 | 70.1 | 70.1 |
| TMP | 8 | 8 | 8 | 8 | 8 | 8 |
| 2-pyrrolidone | 7 | 7 | 7 | 7 | 7 | 7 |
| PEG200 | 5 | 0 | 0 | 0 | 4.9 | 2 |
| PEG diacrylate | 0 | 5 | 0 | 0 | 0 | 0 |
| Vinyl acetate | 0 | 0 | 5 | 0 | 0 | 0 |
| Butyl acetate | 0 | 0 | 0 | 5 | 0 | 0 |
| $HNO_3$ (0.1M) | 0 | 0 | 0 | 0 | 0.1 | 0 |
| $NH_4NO_3$ | 0 | 0 | 0 | 0 | 0 | 3 |

-continued

| | Formulation "A" (%) | Formulation "B" (%) | Formulation "C" (%) | Formulation "D" (%) | Formulation "E" (%) | Formulation "F" (%) |
|---|---|---|---|---|---|---|
| Butylcarbytol | 3 | 3 | 3 | 3 | 3 | 3 |
| Berol 260 by Akzo Nobel | 0.3 | 0.3 | 0.3 | 0.3 | 0.3 | 0.3 |
| Dowfax 3B2 by Dow Chemical Company | 1.5 | 1.5 | 1.5 | 1.5 | 1.5 | 1.5 |
| EDTA 2% | 1 | 1 | 1 | 1 | 1 | 1 |
| PreventolD6 by Bayer | 0.1 | 0.1 | 0.1 | 0.1 | 0.1 | 0.1 |
| Pro-jet yellow 1 G by Fujifilm Imaging Colorants | 3 | 3 | 3 | 3 | 3 | 3 |
| PH | 6.6 | 4.7 | 4.3 | 5.6 | 3 | 4 |

The chemical aggressiveness of the inks against photopolymer material are tested by immersing the ink-jet print heads made according to the invention into the above-mentioned formulations at a temperature of 65° C.

The test ink-jet print heads are periodically observed (1 day and 1, 3, 5 and 7 weeks) under optical microscope in order to reveal the presence of detachments from the metal substrate.

The rooms hydraulics is photodefined, in the print heads under test, by two polymer layers: an adhesive first layer with thickness of 2 μm made only of epoxy resin, and a second layer, overlaying the adhesive first layer with a thickness of 12 μm made of epoxy-olefinic resin.

The surfaces in contact with the polymer material are gold, tantalum and silicon carbide.

Formulation "A", having a pH value of 6, causes detachments of the epoxy resin after 1 day only of immersion at 65° C.; the detachments are mainly located on the interfaces polymer/gold, this being substantially due to the gold chemical-physical properties.

Formulation "B", having a pH value of 4.7, clearly reduces infiltrations and detachments of the epoxy resin even after 1 week of immersion at 65° C.; this result is already sufficient to avoid the appearance of electrical defects in ink-jet print heads maintained in temperature up to 7 weeks.

Formulation "C", having a pH value of 4.3, eliminates the detachments of the epoxy resin up to 7 weeks of immersion at 65° C.

Formulation "D", having a pH value of 5.6, causes detachments of the epoxy resin after 1 day only of immersion at 65° C.

Formulation "E", having a pH value of 3, does not cause any detachment of the resin up to 7 weeks of immersion at 65° C.

Formulation "F", having a pH value of 4, does not cause any detachment of the resin up to 3 weeks of immersion at 65° C.; this result is already sufficient to avoid the appearance of electrical defects in ink-jet print heads maintained in temperature up to 7 weeks.

Therefore, from the examples hereinabove, it results that the decrease of the detachments is proportional to the acidity of the water-based ink containing acidic species.

The ink having a pH value of 3, according to Formulation "E", is considered as a limit, because a too high acidity of the liquid could cause side effects with other components of the print head, in particular a too high acidity can make the colorant to precipitate in the formulation because, as the colorant is introduced inside the formulation under a saline form, it protons itself thereby desolubilising.

The Applicant has thus determined that, in order to make less critical the adhesion with time of photopolymers in contact with an ink, specifically at high temperatures, it is sufficient to reduce the pH value of the ink itself so to make it to act as "curing agent" of the adhesive first layer partially polymerised; in this way, the acidified ink induces the polymerisation of the residual functionalities of the adhesive first layer by permeating inside the polymer, thus increasing the chemical resistance of the material.

The Applicant has also performed DSC analysis of the adhesive first layers used in the ink-jet print heads tested as described above in order to prove its residual reactivity and its positive interaction with the water-based inks containing acidic species; specifically, said analysis is aimed to quantify the potential residual portion of cross-linking present in the processed material before and after contacting it with two ink formulations, the former about neutral and the latter containing acidic species.

Figure 7:
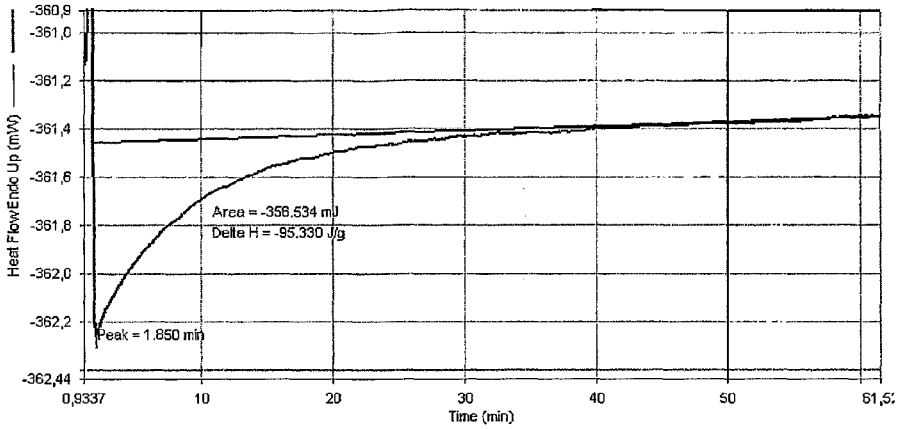
FIG. 7 shows a DSC thermogram relevant to the adhesive first layer of the photopolymer barrier before being contacted with ink.
Figure 8:
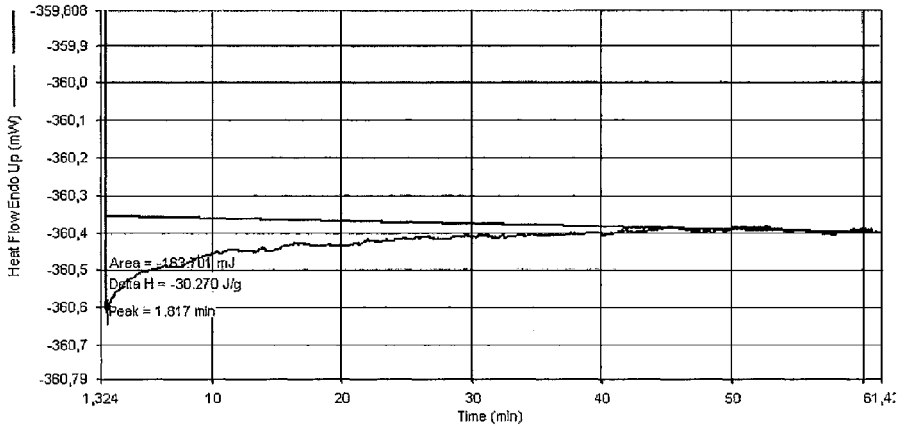
FIG. 8 shows a DSC thermogram relevant to the adhesive first layer of the photopolymer barrier after being contacted with an ink having a pH value of 6.
Figure 9:
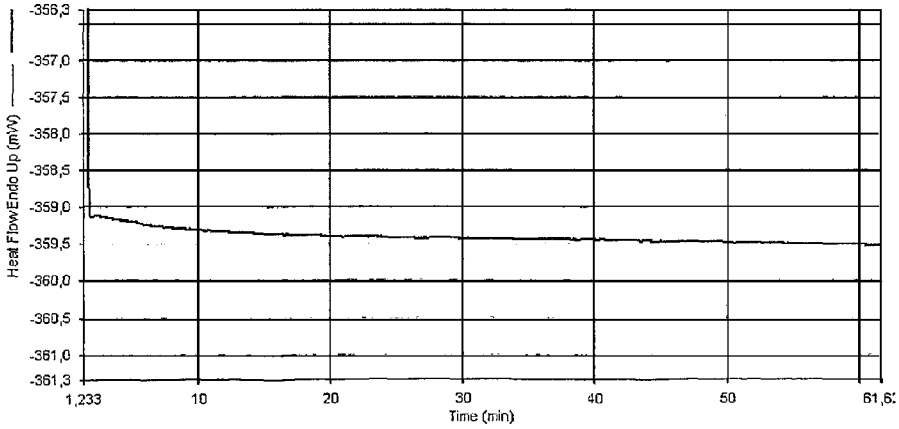
FIG. 9 shows a DSC thermogram relevant to the adhesive first layer of the photopolymer barrier after being contacted with an ink having a pH value of 4.7.

FIGS. 7, 8 and 9 show DSC thermograms reporting the analysis of said adhesive first layer, respectively, before being contacted with ink, after being contacted with the ink having a pH value of 6 according to Formulation "A" and after being contacted with the ink having a pH value of 4.7 according to Formulation "B"; said DSC thermograms represent the unexpressed residual reaction heat of the material.

The adhesive first layer, as already cited, was made of an epoxy resin; it has been observed that the residual heat released from the material is lower after the contact with the water-based inks containing acidic species than it was before, this meaning that the sample immersed into a water-based ink containing acidic species has a residual portion of cross-linking lower than that of the sample immersed into a water-based ink not containing acidic species.

The samples were immersed into water-based inks at 65° C. for 1 week and they exhibited an exothermic peak of residual cross-linking lower than the sample simply processed and not contacted with ink.

Without wanting to be bound by this thesis, this can be linked to the fact that the polymerisation reaction of the residual epoxy functionalities occurs in any case at high temperatures in a water-based medium; by using formulation "A", however, such a reaction is too slow to be competitive with respect to the permeation of the ink into the polymer.

On the other hand, the presence of acid species inside the water-based inks according to the invention is likely to make the reaction more competitive with respect to the permeation of the ink into the polymer.

The invention claimed is:

1. A process for manufacturing an ink-jet print head for an ink-jet printer comprising a photopolymer barrier defining ink passage ways and ejection chambers formed on a substrate, said process comprising the steps of:

providing a substrate, applying, on said surface of said substrate, an adhesive first layer of a photopolymer barrier, said first layer being made of a partially polymerized cationically polymerizable material, applying a second layer above said first layer, said second layer being made of photopolymerizable material, providing ink passage ways and ejection chambers, and contacting said ink-jet print head with a water-based ink containing acidic species with a pH value between 3 and 5 so as to further polymerize said partially polymerized adhesive first layer of said photopolymer barrier, thus improving the photopolymer barrier adhesion on said surface of said substrate with time.

2. The process for manufacturing an ink-jet print head according to claim 1, including forming on the surface of the substrate a plurality of ink ejection energy generating elements.

3. The process for manufacturing an ink-jet print head according to claim 1, wherein said cationically polymerizable material partially polymerized forming said adhesive first layer is selected from the group consisting of epoxy resins.

4. The process for manufacturing an ink-jet print head according to claim 1, wherein said water-based ink containing acidic species is obtained by adding to water an acid or a substance able to release an acid.

5. The process for manufacturing an ink-jet print head according to claim 4, wherein said acid or said substance able to release an acid is selected from the group consisting of non-corrosive inorganic acids, organic acids, hydrolysable salts and hydrolysable esters.

6. The process for manufacturing an ink-jet print head according to claim 5, wherein said acid or said substance able to release an acid is selected among hydrolysable esters.

7. The process for manufacturing an ink-jet print head according to claim 6, wherein said hydrolysable esters are hydrolysable acrylic esters.

8. The process for manufacturing an ink-jet print head according to claim 7, wherein said hydrolysable acrylic esters are polyethylene glycol (PEG) diacrylates.

9. The process for manufacturing an ink-jet print head according to claim 8, wherein said hydrolysable acrylic esters are PEG diacrylates with molecular weight comprised between 200 amu and 1,000 amu.

10. The process for manufacturing an ink-jet print head according to claim 4, wherein said water-based ink containing acidic species reaches a pH value comprised between 3 and 5 over time.

11. A process of polymerizing at least a part of an ink-jet print head for an ink-jet printer in a water-based ink containing acidic species with a pH value between 3 and 5, said ink-jet print head comprising at least a substrate and a photopolymer barrier applied onto said substrate, said photopolymer barrier comprising an adhesive first layer being made of a partially polymerized cationically polymerizable material and a second layer being made of a photopolymerizable material applied above said first layer, said process comprising:

contacting the adhesive first layer with the water-based ink containing acidic species having a pH value between 3 and 5, whereby the adhesive first layer is further polymerized, so as to improve a photopolymer barrier adhesion on said surface of said substrate over time.

* * * * *

UNITED STATES PATENT AND TRADEMARK OFFICE

CERTIFICATE OF CORRECTION

PATENT NO. : 8,968,832 B2
APPLICATION NO. : 12/988490
DATED : March 3, 2015
INVENTOR(S) : D. Ciampini et al.

It is certified that error appears in the above-identified patent and that said Letters Patent is hereby corrected as shown below:

Title page, item (73) Assignee, of the printed patent, "SICPA Holding SA" should read -- SICPA HOLDING SA --.

Title page, item (57) Abstract, column 2, line 8, please change "contacted ny a" to -- contacted by a --.

Signed and Sealed this
Tenth Day of November, 2015

Michelle K. Lee

Michelle K. Lee
*Director of the United States Patent and Trademark Office*